US008052491B2

(12) United States Patent
Lin

(10) Patent No.: US 8,052,491 B2
(45) Date of Patent: Nov. 8, 2011

(54) ELECTRICAL CONTACT HAVING UPPER CONTACT WITH THICKENED BASE PORTION

(75) Inventor: Chun-Fu Lin, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/835,758

(22) Filed: Jul. 14, 2010

(65) Prior Publication Data

US 2011/0014823 A1 Jan. 20, 2011

(30) Foreign Application Priority Data

Jul. 14, 2009 (TW) ..... 098212836

(51) Int. Cl.
*H01R 4/48* (2006.01)
*H01R 11/03* (2006.01)

(52) U.S. Cl. ..... 439/786; 439/700; 439/841

(58) Field of Classification Search ..... 439/786, 439/841, 908, 891, 700, 788; 324/754.05, 324/754.14

See application file for complete search history.

(56) References Cited

U.S. PATENT DOCUMENTS

| | | | | |
|---|---|---|---|---|
| 7,025,602 | B1 * | 4/2006 | Hwang | 439/66 |
| 7,256,593 | B2 * | 8/2007 | Treibergs | 324/754.05 |
| 7,467,952 | B2 * | 12/2008 | Hsiao et al. | 439/66 |
| 7,520,754 | B1 * | 4/2009 | Gattuso | 439/66 |
| 7,559,769 | B2 * | 7/2009 | Hsiao et al. | 439/66 |
| 7,559,806 | B2 * | 7/2009 | Lin et al. | 439/700 |
| 7,789,671 | B2 * | 9/2010 | Hsieh et al. | 439/66 |
| 7,815,440 | B2 * | 10/2010 | Hsieh et al. | 439/66 |
| 7,841,864 | B2 * | 11/2010 | Hsiao et al. | 439/66 |
| 7,841,866 | B2 * | 11/2010 | Hsu et al. | 439/66 |
| 7,845,988 | B2 * | 12/2010 | Hsiao et al. | 439/700 |
| 7,862,343 | B1 * | 1/2011 | Lin et al. | 439/66 |
| 7,878,867 | B2 * | 2/2011 | Lin | 439/700 |

* cited by examiner

*Primary Examiner* — Hae Moon Hyeon

(74) *Attorney, Agent, or Firm* — Andrew C. Cheng; Wei Te Chung; Ming Chieh Chang

(57) ABSTRACT

An electrical contact (1) comprises an upper contact (10), a lower contact (12) and a spring (14) located between the upper contact (10) and the lower contact (12). The upper contact (10) comprises a first contacting portion (104) at one end thereof and a first mating end (108) comprising two contacting sheets overlapped at an opposite end thereof, and a lower contact comprises a second contacting portion and a second mating end defining a channel, the channel providing a space to allow movement of the first mating end.

20 Claims, 6 Drawing Sheets

ELECTRICAL CONTACT HAVING UPPER CONTACT WITH THICKENED BASE PORTION

BACKGROUND OF THE INVENTION

1. Field of the Invention

The present invention relates to an electrical contact, and more particularly to a contact terminal having a thickened tail portion so as to readily incorporate with a complement lower portion such that the lower contact can be readily and easily manufactured and an adverse and unwanted disconnection therebetween can be prevented.

2. Description of the Prior Art

An conventional electrical contact is used to electrically connecting a Central Processing Unit (CPU) with a Printed Circuit Board (PCB). The electrical contact comprises an upper contact, a lower contact and a spring disposed between the upper contact and the lower contact. The upper contact comprises a flat base portion with a first contact portion at the top end. The lower contact comprises a flat body portion and a pair of arm portions extending upwardly from the body portion. The bottom end of the body portion has a second contact portion. The base portion is sandwiched between the arms and the arms which can move along the base portion.

When the CPU presses down the upper contact, the upper contact moves downwardly and presses the spring accordingly; the arms moves along the base portion of the upper contact and contacts with the base portion all along. When the CPU is removed, the elastic force of the spring will push the upper contact to move upwardly to the initial stage. The upper contact is made of sheet material and the thickness of the base portion is comparably thin. Thus, the distance between the pair of arms has to be precisely dimensioned and controlled to ensure the interconnection with the base portion. Therefore, this type of lower contact is difficult to be manufactured. Furthermore, disconnection may occur between the upper contact and the lower contact.

In view of the above, a new electrical contact that overcomes the above-mentioned disadvantages is desired.

SUMMARY OF THE INVENTION

Accordingly, an object of the present invention is to provide to an electrical contact having a thickened tail portion so as to readily incorporate with a complement lower portion such that the lower contact can be readily and easily manufactured and an adverse and unwanted disconnection therebetween can be prevented.

To fulfill the above-mentioned object, an electrical contact comprises an upper contact, a lower contact and a spring located between the upper contact and the lower contact. The upper contact comprises a first contacting portion at one end thereof and a first mating end comprising two contacting sheets overlapped at an opposite end thereof, and a lower contact comprises a second contacting portion and a second mating end defining a channel, the channel providing a space to allow movement of the first mating end.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Figure 1:
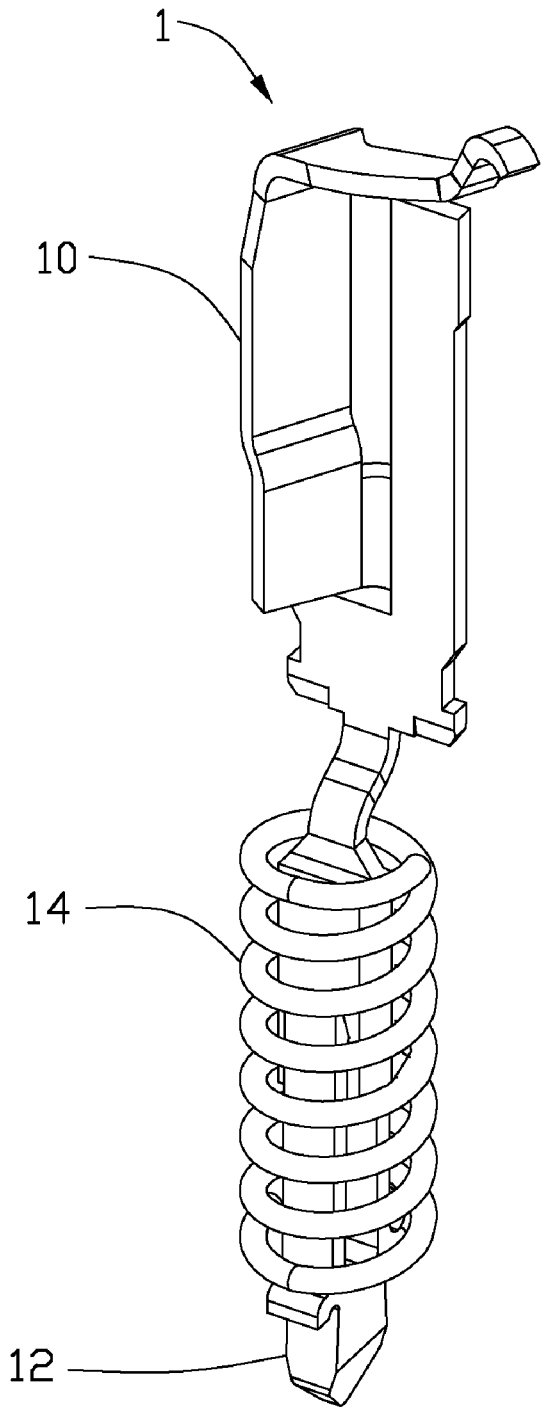
FIG. 1 is an isometric, assembled view of an electrical contact in accordance with a first preferred embodiment of the present invention.
Figure 2:
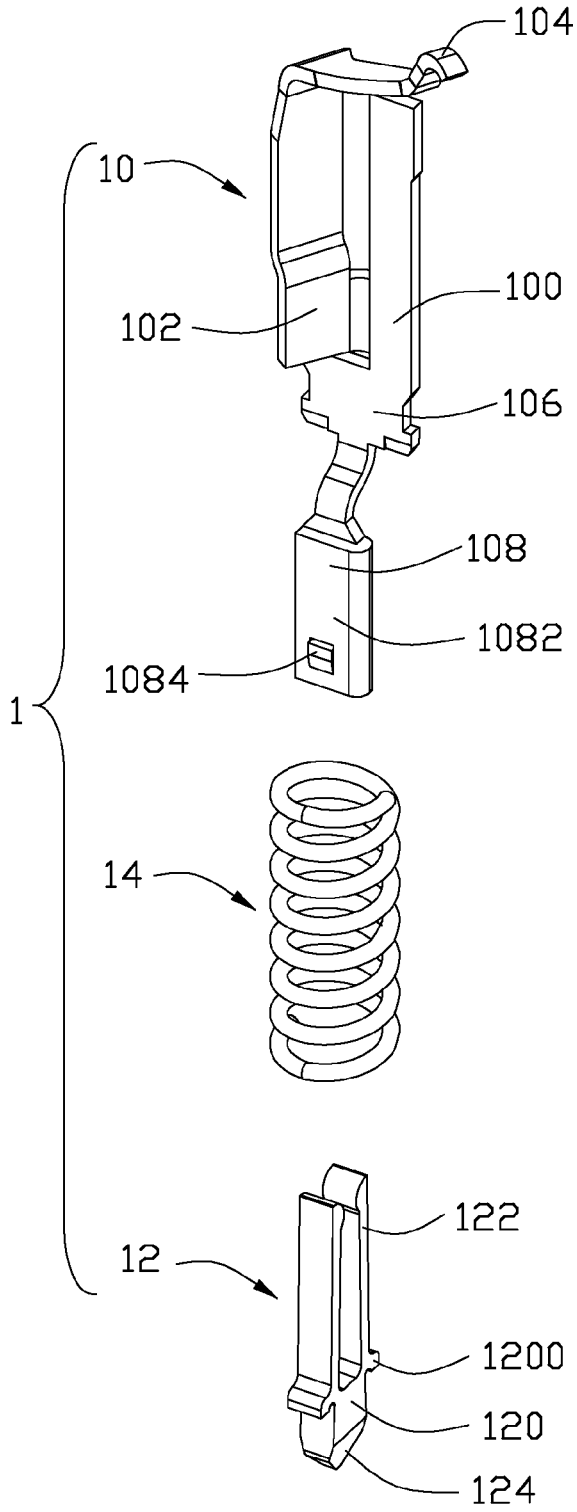
FIG. 2 is an exploded view of the electrical contact in accordance with the first preferred embodiment of the present invention.

Reference will now be made to the drawings to describe the present invention in detail.

Referring to FIGS. 1-4, the electrical contact 1 is used to electrically connecting a Central Processing Unit (CPU) (not shown) with a Printed Circuit Board (PCB) (not shown). The electrical contact 1 comprises an upper contact 10, a lower contact 12 and a spring 14 disposed and located between the upper contact 10 and the lower contact 12.

The upper contact 10 comprises a base portion 100, a connecting portion 102 extending from one side of the base portion 100, a first contacting portion 104 bent upwardly from the connecting portion 102, a retaining portion 106 extending from a bottom end of the base portion 100, and a first mating end 108 extending along a vertical direction from the retaining portion 106. The first mating end 108 comprises two contacting sheets 1080, 1082 overlapped each other. The two contacting sheets 1080, 1082 each defines a hook 1084 for engaging with the lower contact 12.

Figure 3:
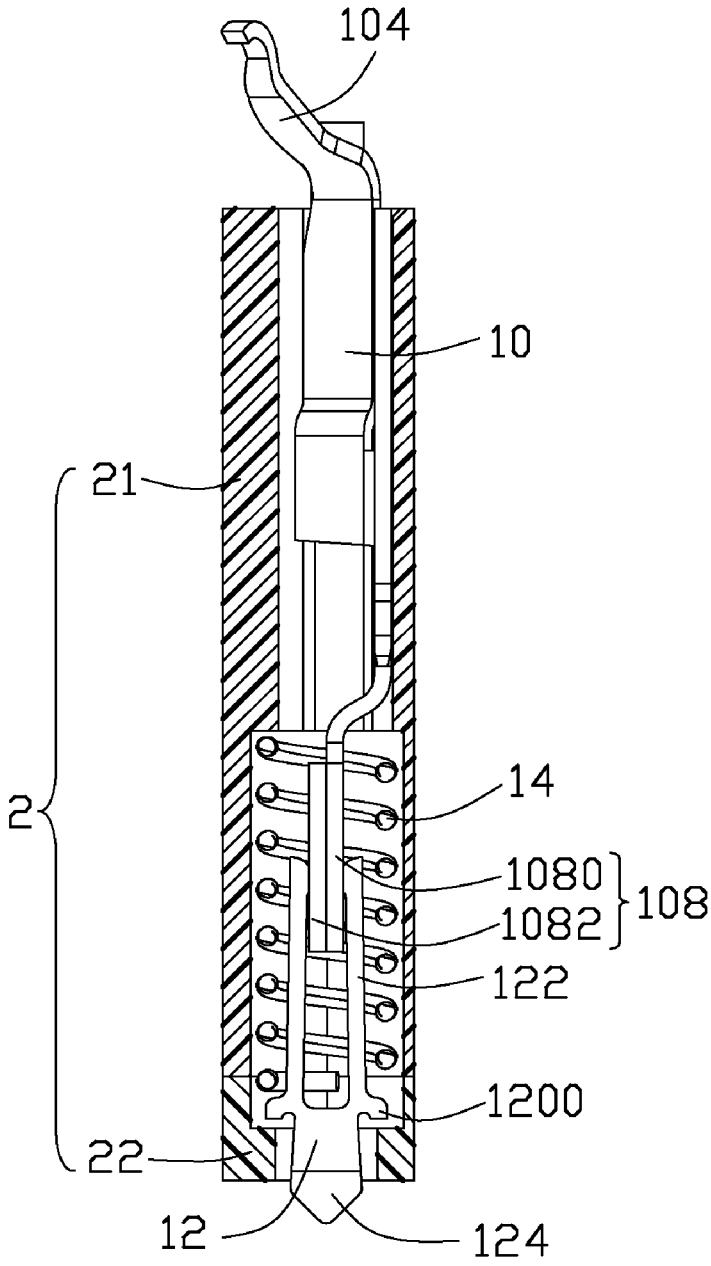
FIG. 3 is a cross-sectional view of an insulative housing in which the electrical contact shown in FIG. 1 (is) received.
Figure 4:
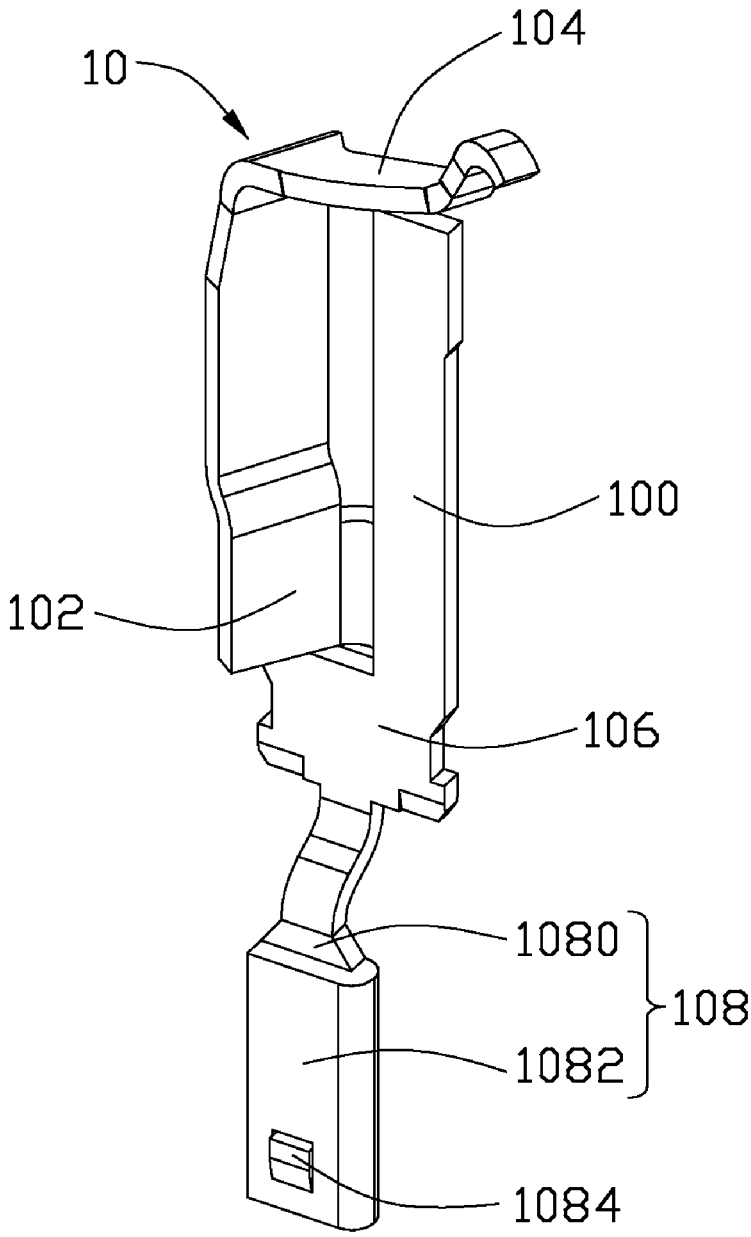
FIG. 4 is an isometric view of an upper contact shown in FIG. 1.

The lower contact 12 comprises a base 120 and a second mating end 122 extending upwardly from a top portion of the base 120. The second mating end 122 comprises two spaced arms. A channel is defined between those two arms for allowing movement of the first contacting end 108. The lower contact 12 defines a second contacting portion 124 extending vertically from a bottom portion of the second mating end 122. A pair of stoppers 1200 is located at opposite sides of the base 120 for positioning the spring 14. Referring to FIG. 3, the first contacting portion 104 and the second contacting portion 124 are located at two different vertical planes, respectively. Thus, the electrical contact 1 may be used under condition that a pad of an electrical package and a corresponding pad of a PCB located at different vertical planes.

The spring 14 is located between the upper contact 10 and the lower contact 12. Referring to FIG. 3, one end of the spring 14 is supported by the pair of stoppers 1200 and opposite end of the spring 14 abuts against a step formed on a lower portion of the inner walls of the upper housing 21. Elastic force is generated by the spring 14 due to elastic deformation thus ensuring reliable electrical connection between the PCB and the electrical package.

Three preferred embodiments of the present invention is provided. The lower contact 12 of each embodiment are the same. The upper contact has three embodiments. Difference between the three upper contacts is the first mating end.

Referring to FIGS. 1-4, the upper contact 10 of the first embodiment is shown. The two contacting sheets 1080, 1082 are integrally formed by the art of stamping. The contacting sheet 1082 bends from a side of the contacting sheet 1080.

Figure 5:
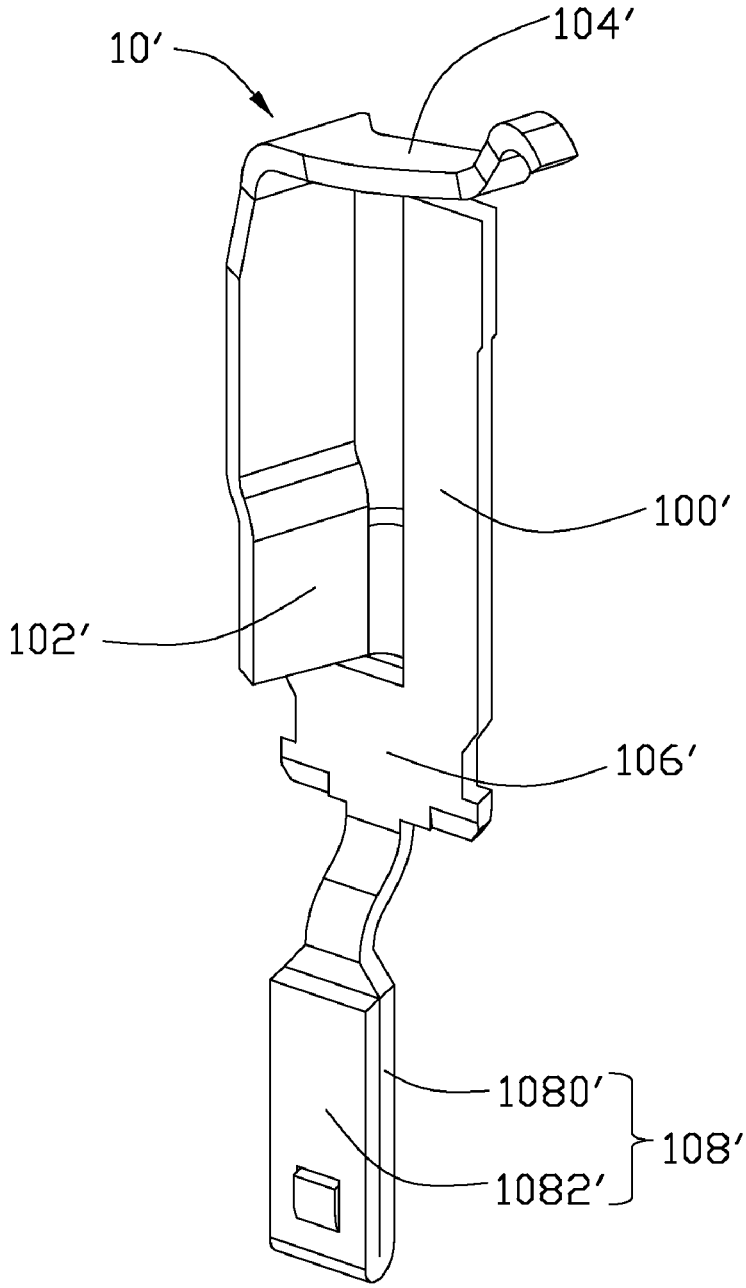
FIG. 5 is an isometric view of an upper contact in accordance with a second preferred embodiment of the present invention.

Referring to FIG. 5, the upper contact 10' of the second embodiment is shown. The upper contact 10' comprises a base portion 100', a connecting portion 102' extending from one side of the base portion 100', a first contacting portion 104' bends upwardly from the connecting portion 102', a retaining portion 106' extending from a bottom end of the base portion 100', and a first mating end 108' extending along a vertical direction from the retaining portion 106'. The contacting sheet 1082' bends from a bottom end of the contacting sheet 1080'.

Figure 6:
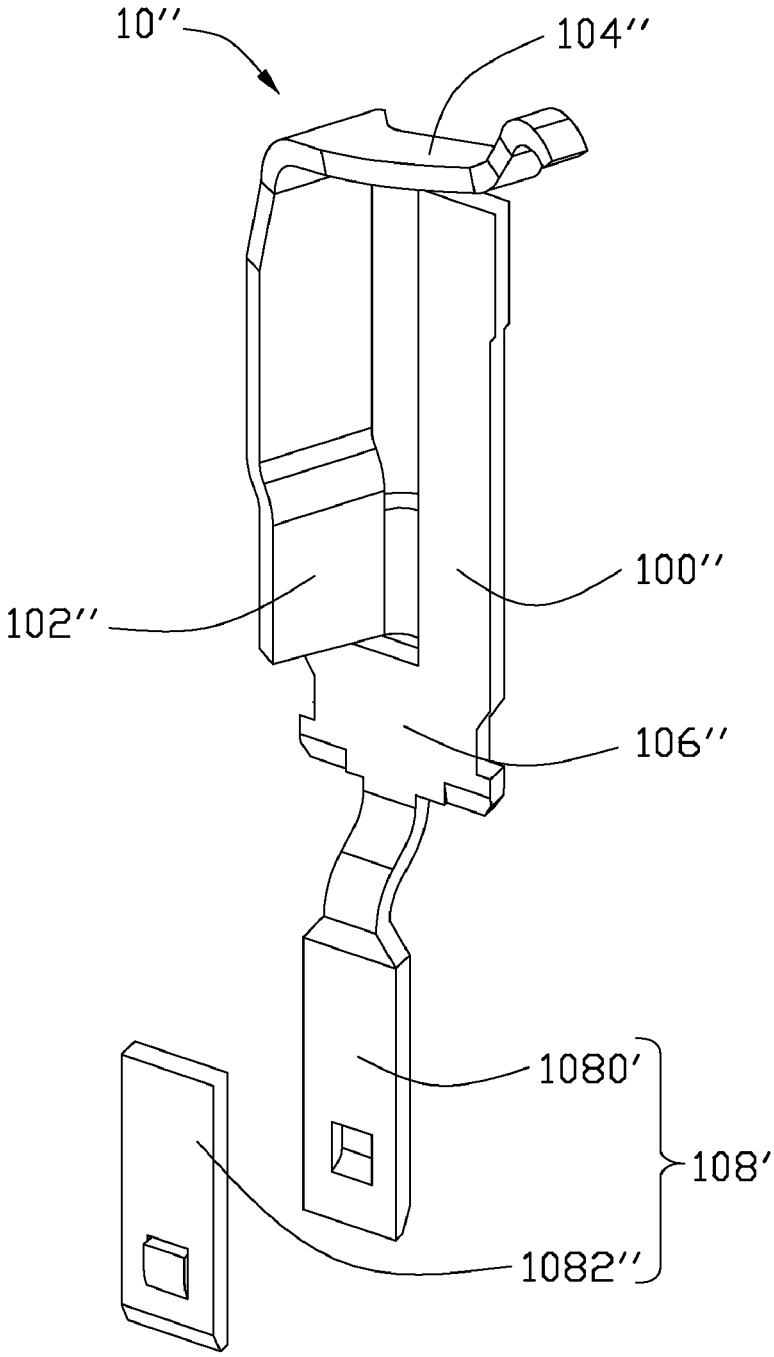
FIG. 6 an isometric view of an upper contact in accordance with a third preferred embodiment of the present invention.

Referring to FIG. 6, the upper contact 10" of the third embodiment is shown. The upper contact 10" comprises a base portion 100", a connecting portion 102" extending from one side of the base portion 100", a first contacting portion 104" bend upwardly from the connecting portion 102", a retaining portion 106" extending from a bottom end of the base portion 100", and a first mating end 108" extending along a vertical direction from the retaining portion 106". The contacting sheet 1082" bends from a bottom end of the contacting sheet 1080". Two contacting sheets 1080", 1082" are separable from each other.

Referring to FIG. 3, the electrical contact 1 of the first embodiment is received in the housing 2. The upper contact 10 and the lower contact 12 are received in the upper housing 21 and a lower housing 22, respectively. The first mating end 108 of the upper contact 10 is inserted into the channel of the second mating end 122 of the lower contact 12. Because the upper contact 10 comprises two overlapped contacting sheets 1080, 1082, so that the pair of arms contact with the two contacting sheets 1080, 1082 respectively, so the distance between the pair of arms are added. Thus, the lower contact 12 is easy to be manufactured and can prevent the disconnection between the hooks 1084 and the two contacting sheets 1080, 1082.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical contact comprising:

an upper contact defining a first contacting portion at one end thereof and a first mating end at an opposite end thereof, the mating end being of a multiple layer structure and extending along a vertical direction;

a lower contact comprising a second contacting portion and a second mating end formed with a pair of arms for holding the first mating end; and a spring located between the upper contact and the lower contact; and wherein the first contacting portion and the second contacting portion are located at two different vertical planes, respectively.

2. The electrical contact as claimed in claim 1, wherein the first mating end has two layers overlapping each other.

3. The electrical contact as claimed in claim 2, wherein the first mating end comprises a main portion and an additional portion overlapping the main portion.

4. The electrical contact as claimed in claim 3, wherein the additional portion bends from a bottom end of the main portion and extends upwardly.

5. The electrical contact as claimed in claim 3, wherein the additional portion is separable from the main portion.

6. The electrical contact as claimed in claim 1, wherein the upper contact comprises a base portion, a connecting portion interconnecting with the base portion and the first contacting portion, and a retaining portion extending from the base portion, the first mating end extending from the retaining portion.

7. The electrical contact as claimed in claim 3, wherein the main portion and the additional portion each defines a hook thereon for engaging with one of the pair of arms.

8. An electrical contact comprising:

an upper contact defining a first contacting portion at one end thereof and a first mating end extending along a vertical direction at an opposite end thereof;

a lower contact comprising a second contacting portion and a second mating end defining a channel, the channel providing a space to allow movement of the first mating end; and wherein the first mating end comprises at least two contacting layers overlapped each other.

9. The electrical contact as claimed in claim 8, wherein a spring located between the upper contact and the lower contact.

10. The electrical contact as claimed in claim 8, wherein the first mating end comprises two contacting sheets.

11. The electrical contact as claimed in claim 10, wherein one of the two contacting sheets extends from a bottom end of the other one.

12. The electrical contact as claimed in claim 11, wherein the one of the two contacting sheets is separable from the other one.

13. The electrical contact as claimed in claim 12, wherein the lower contact defines a second contacting portion extending vertically from a bottom portion of the second mating end.

14. The electrical contact as claimed in claim 11, wherein the two contacting sheets each defines a hook thereon for interferentially engaging with inner walls of the channel.

15. An electrical contact assembly comprising:

an insulative housing defining a passageway extending through opposite first and second faces thereof;

opposite first and second contacts assembled to each other along an axial direction, the first contact including a first contact portion extending beyond the first face and a first mating portion with a retaining portion therebetween under condition that said retaining portion retaining said first contact in the passageway, the second contact including a second contact portion extending beyond the second face and a second mating portion interengaging the first mating portion; wherein a spring located in the passageway and defining one end directly abutting against a step structure of the housing in the passageway, and an opposite end directly abutting against the second contact to urge the second contact away from the first contact and expose said second contact portion to an exterior.

16. The electrical contact assembly as claimed in claim 15, wherein the first mating portion is formed by a plurality of layers each defining a thickness of sheet metal forming said first contact.

17. The electrical contact assembly as claimed in claim 16, wherein the second mating portion defines a fork structure with thereof two opposite arms sandwiching the first mating portion therebetween.

18. The electrical contact assembly as claimed in claim 16, wherein said first mating portion defines a pair of opposite hooks unitarily and outwardly extending and split from the corresponding layers, respectively, to interlock with corresponding inward protrusions at said two opposite arms of the fork structure.

19. The electrical contact assembly as claimed in claim 15 wherein the retaining portion is not axially aligned with and offset from the first mating portion.

20. The electrical contact assembly as claimed in claim 15, wherein said housing includes two opposite pieces to commonly define said passageway for consideration of assembling the first contact, the second contact and the spring therein.

* * * * *